US010899490B2

(12) United States Patent
Kronseder

(10) Patent No.: US 10,899,490 B2
(45) Date of Patent: Jan. 26, 2021

(54) APPARATUS AND METHOD FOR LABELING CONTAINERS

(71) Applicant: KRONES AG, Neutraubling (DE)

(72) Inventor: Volker Kronseder, Neutraubling (DE)

(73) Assignee: KRONES AG, Neutraubling (DE)

( * ) Notice: Subject to any disclaimer, the term of this patent is extended or adjusted under 35 U.S.C. 154(b) by 0 days.

(21) Appl. No.: 15/738,547

(22) PCT Filed: Apr. 14, 2016

(86) PCT No.: PCT/EP2016/058160
§ 371 (c)(1),
(2) Date: Dec. 20, 2017

(87) PCT Pub. No.: WO2017/001076
PCT Pub. Date: Jan. 5, 2017

(65) Prior Publication Data

US 2018/0186492 A1 Jul. 5, 2018

(30) Foreign Application Priority Data

Jun. 30, 2015 (DE) ..... 10 2015 212 136

(51) Int. Cl.
*B65C 9/14* (2006.01)
*B65C 9/22* (2006.01)
(Continued)

(52) U.S. Cl.
CPC ..... *B65C 9/14* (2013.01); *B41J 2/155* (2013.01); *B65C 9/2217* (2013.01);
(Continued)

(58) Field of Classification Search
CPC .... B65C 2009/0059; B65C 2009/0071; B65C 9/14; B65C 9/2217; B65C 9/2265; B41J 2/01–2/2146
See application file for complete search history.

(56) References Cited

U.S. PATENT DOCUMENTS 3,252,441 A 5/1966 Hargreaves
3,723,228 A 3/1973 Schaltegger
(Continued)

FOREIGN PATENT DOCUMENTS

CA 1004634 A 2/1977
CH 431253 A 2/1967
(Continued)

OTHER PUBLICATIONS

Translated Written Opinion of PCT/EP2016/058160.*
(Continued)

*Primary Examiner* — Sonya M Sengupta
(74) *Attorney, Agent, or Firm* — McCoy Russell LLP

(57) ABSTRACT

The present invention provides an apparatus and a method for applying labels to containers or packs, comprising the following steps: taking over a label from a label providing unit by means of a pallet such that a glue application surface of the label faces away from the pallet; conveying the label by means of the pallet past a glue application unit, where the glue application surface of the label has cold glue applied thereto, at least over part of its area; and, subsequently, directly transferring the glue-coated label to a container conveyed by a conveyer or to a pack conveyed by the conveyor.

22 Claims, 6 Drawing Sheets

(51) Int. Cl.

| | |
|---|---|
| ***B41J 2/155*** | (2006.01) |
| ***B65C 9/00*** | (2006.01) |
| ***B41J 2/14*** | (2006.01) |

(52) U.S. Cl.
CPC ..... *B65C 9/2265* (2013.01); *B41J 2/14* (2013.01); *B65C 2009/0059* (2013.01); *B65C 2009/0071* (2013.01)

(56) References Cited

U.S. PATENT DOCUMENTS

| | | | | |
|---|---|---|---|---|
| 3,736,213 | A | 5/1973 | Jorss et al. | |
| 3,768,439 | A * | 10/1973 | Schweitzer | B65C 9/2217 118/315 |
| 4,977,006 | A * | 12/1990 | Smith | G09F 3/02 156/234 |
| 5,174,852 | A * | 12/1992 | Zepf | B65C 9/16 156/564 |
| 6,598,647 | B1 | 7/2003 | Draghetti | |
| 7,625,625 | B2 * | 12/2009 | Rios | B32B 27/34 428/141 |
| 8,616,259 | B1 | 12/2013 | Woods et al. | |
| 2007/0029036 | A1 * | 2/2007 | Fort | B65C 9/2208 156/291 |
| 2011/0244115 | A1 * | 10/2011 | Otruba | B05C 5/0258 427/9 |
| 2012/0067502 | A1 * | 3/2012 | Piana | B65C 9/44 156/64 |

FOREIGN PATENT DOCUMENTS

| | | | | |
|---|---|---|---|---|
| DE | 1102640 | B | 3/1961 | |
| DE | 1111563 | B | 7/1961 | |
| DE | 3014862 | A1 | 10/1980 | |
| DE | 69802165 | T2 | 6/2002 | |
| DE | 102012101503 | A1 | 8/2013 | |
| DE | 202013100352 | U1 | 4/2014 | |
| EP | 1712476 | A1 | 10/2006 | |
| EP | 211159 | B1 | 3/2013 | |
| GB | 1105283 | A * | 3/1968 | B65C 9/20 |
| JP | 2002002643 | A | 1/2002 | |
| WO | 2008086870 | A1 | 7/2008 | |
| WO | 2012107123 | A1 | 8/2012 | |
| WO | 2013124486 | A1 | 8/2013 | |
| WO | 2014114678 | A1 | 7/2014 | |

OTHER PUBLICATIONS

ISA European Patent Office, International Search Report Issued in Application No. PCT/EP2016/058160, dated Jul. 19, 2016, WIPO, 6 pages.

* cited by examiner

APPARATUS AND METHOD FOR LABELING CONTAINERS

CROSS-REFERENCE TO RELATED APPLICATIONS

The present application is a U.S. National Phase of International Patent Application Serial No. PCT/EP2016/058160, entitled "APPARATUS AND METHOD FOR LABELLING CONTAINERS," filed on Apr. 14, 2016. International Patent Application Serial No. PCT/EP2016/058160 claims priority to German Patent Application No. 10 2015 212 136.4, filed on Jun. 30, 2015. The entire contents of each of the abovementioned applications are hereby incorporated by reference in their entirety for all purposes.

FIELD OF THE INVENTION

The present invention relates to an apparatus and a method for applying glue to labels of different shapes and sizes and for applying these labels to containers or packs.

PRIOR ART

Labeling machines are used in industry to apply, continuously and with high performance, labels to continuously fed articles, containers or packs of containers. The containers may be glass bottles, plastic bottles, in particular PET bottles, cans or can-like containers or the like, which are filled with liquid or solid foodstuff, medical or cosmetic products, hygiene products or the like. The labeling machines normally comprise an often modular labeling unit.

Such labeling units for labeling machines, in particular also for circulating-type labeling machines, for applying labels, in particular also paper labels, to bottles or similar containers making use of cold glue are known in the prior art. Such units comprise as a matter of principle at least one pallet carrier or glue segment carrier, which is adapted to be driven for circulation around a vertical axis of the unit and which is also referred to as pallet carousel, having provided thereon a plurality of label pallets or glue segments respectively defining at least one label reception or contacting surface. The pallets or glue segments are configured such that they are pivotable in a controlled manner about a pivot axle of their own. During the labeling process, the pallets or glue segments are, in the course of each circulation of the glue segment carrier, first moved past a glue application station for producing a glue coat on their label contacting surface, whereupon they are moved past a label dispensing station from which a respective label is taken over, which then adheres with its back to a label contacting surface provided with the glue coat, whereby glue will simultaneously be applied to the back of the label. Via a gripper cylinder, the respective glue-coated labels are transferred to the containers that are moved past the labeling unit.

The application of glue to the glue segments or to the label contacting surfaces thereof takes place at the glue application station of conventional labeling units via a rotationally driven glue roller whose circular cylindrical circumferential surface has a glue film applied thereto by means of a glue application bar. Such glue rollers have a complex structural design and they are expensive. Furthermore, they are subjected to high wear and they also cause substantial contamination of the labeling unit as well as of the labeling machine by splashing glue.

EP 2 111 359 B1 describes a labeling unit for use in labeling machines for labeling bottles or similar containers with labels using cold glue, comprising at least one glue segment, which can be driven such that it circulates about an axis of the unit and at the same time can also be pivoted in a controlled manner about a pivot axle that is radially displaced in relation to the axis of the unit, said glue segment forming a label contacting surface. A gluing station as well as at least one label dispensing station configured for dispensing the labels to the respective passing label contacting surface are arranged on the circulatory path of the label contacting surface of the at least one glue segment, the gluing station comprising at least one glue application nozzle on the path of movement of the label contacting surface of the at least one glue segment for directly applying the glue to the respective label contacting surface passing by. The labels are, as usual, taken over from the glue-coated label contacting surface and simultaneously coated with glue. Subsequently, the glue-coated labels are transferred to a gripper cylinder, which transfers them to the bottles.

The labeling unit described is disadvantageous insofar as the glue is applied to the pallet and, subsequently, the labels are removed from the label magazine by the glue-coated pallets, whereby, as is generally known, the glue may be spread and contaminations may be caused. Likewise, the use of the gripper cylinder leads to a complex structural design, which is, moreover, maintenance prone.

Therefore, it is the object of the present invention to provide a labeling unit, which is used for labeling containers or packs with labels making use of cold glue, and which avoids the above-described drawbacks and, in particular, renders the use of gripper cylinders superfluous. Quite generally, the object underlying the present invention is to reduce the installation and maintenance effort of the labeling machine and to save costs. Moreover, the amount of glue used is to be used optimally.

DESCRIPTION OF THE INVENTION

The above-mentioned objects are achieved by a method for applying labels to containers or packs, comprising the following steps: taking over a label from a label providing unit by means of a pallet, which is adapted to be driven such that it circulates around an axis of rotation and which, as will be described hereinafter, is, in particular, pivotable in a controlled manner about a pivot axle that is displaced relative to the axis of rotation, such that a glue application surface of the label faces away from the pallet; conveying the label by means of the pallet past a glue application unit, where the glue application surface of the label has cold glue applied thereto, at least over part of its area; and, subsequently, directly transferring the glue-coated label to a container conveyed by a conveyor or to a pack conveyed by the conveyor.

As has been mentioned, the containers may be cans, glass bottles, plastic bottles or the like. The labels to be applied may be wrap-around labels or front and rear labels. In addition, shoulder labels and body labels for bottles may be used. The labels may be made of paper, a plastic foil or the like. However, according to the present invention the labels normally have neither any pre-applied glue coat, e.g. after the fashion of an activatable adhesive, nor are they self-adhesive.

The label providing unit may consist of one or a plurality of the label boxes or magazines known in the prior art, which each accommodate a large number of precut labels and make these labels available at the front side thereof for removal by a pallet. However, according to the present invention, the labels in the label boxes are, other than in the case of the prior art, arranged such that the labels are made available at the front side of the label box with their image side, on which the information to be represented is shown. Taking over of the label by a pallet, which, for this purpose, is moved with its label contacting surface past the front side of the label box, is carried out such that the image side of the transferred label will face the contacting surface, i.e. the pallet, whereas the glue application surface of the label provided on the back of the label will face away from the pallet. Thus, the glue application surface is exposed while the label is being conveyed by the pallet, so that it can have glue applied thereto. The glue application surface of the label may comprise the whole area of the label back or only part of the same. In addition, the glue application surface need not necessarily be a continuous surface, but may be defined e.g. by separate areas for leading-edge and trailing-edge glue coating of a label. Also complex glue coat patterns and arrangements of glue application surfaces are imaginable, as will be described hereinafter.

Alternatively to the use of a label box, the labels may also be provided by separating individual labels from a continuous label tape. As is known per se and described e.g. in DE 37 22 220 A1, the label providing unit may, to this end, comprise a stockpiling unit for one or a plurality of label tape rolls, a feed unit for feeding the label tape as well as a cutting unit for separating individual labels from the label tape. The separation may be carried out e.g. by means of a rotating perforating or cutting roll in engagement with the circumferential surface of a mating cutting cylinder, the label tape being here guided between the roll and the mating cutting cylinder. After having been perforated, the labels can be torn off the tape by increasing the conveying speed. The separate labels may subsequently be transferred to the pallet by a vacuum roll. Also in this case, the label tape or the separated labels are oriented such that the glue application surface of the label taken over from the pallet faces away from the contacting surface of the pallet.

As has already been mentioned, label pallets are well known in the prior art. U.S. Pat. No. 3,736,213, for example, describes a so-called pallet carousel comprising a plurality of pallets which are adapted to be driven such that they circulate around an axis of rotation of the carousel for taking over labels from a label magazine and for conveying the labels that have been taken over. To this end, each of the pallets is configured such that it can be pivoted and/or rotated in a controlled manner about a pivot axle of its own, which is radially displaced relative to the axis of rotation. By controlled pivoting and/or rotation of the pallets, the respective curved contacting surface of the latter is brought into contact with the label to be taken over. In U.S. Pat. No. 3,736,213 the adhesion of the glue applied to the contacting surface of the pallet has the effect that a single label is removed from the label box and conveyed by the pallet. According to the present invention, this application of glue to the pallet does no longer take place. Instead, the label to be taken over can be caused to adhere by configuring the pallets in a suitable manner. To this end, the contacting surface of the pallet may e.g. be coated with a material having sufficiently strong adhesion characteristics or it may be provided with suitable gripper elements, like those of a gripper cylinder. A particularly elegant variant is obtained, when the pallets are configured as vacuum pallets as will be described hereinafter.

The pallets may, like those in U.S. Pat. No. 3,736,213, eccentrically be supported on their pivot axles such that the curved contacting surface of the pallet will roll optimally, i.e. without slipping, on a flat surface, as is e.g. the case with a label box or the linear conveyance of the containers described hereinafter. By increasing the eccentricity of support, it will, however, also be possible to realize optimal rolling on a curved surface, as will be the case e.g. when the containers are conveyed by means of a container table. In addition, the eccentricity of support of the pallet on the pivot axle may be changed, if necessary, e.g. via a controllable linear actuator. For example, the eccentricity in the area of the label box may be smaller than that at the point where the labels are transferred to the containers conveyed along a curved path by a container table, an open-loop and/or closed-loop control unit of the labeling machine controlling the change in the eccentricity of the support of the pallet depending on a position of the pallet along the circulatory path. Alternatively, the eccentricity may be changed automatically by one or a plurality of control cams of the pallet carousel, possibly in cooperation with a resetting-type spring device for the support, while the pallets are circulating around the axis of rotation of the carousel. The control cams may here simultaneously also cause pivoting of the pallets. Alternatively, the pivotal movement and/or rotation of the pallets can be effected by means of one or a plurality of servomotors. Also in this case, control will be executed by a suitable open-loop and/or closed-loop control unit of the labeling machine.

According to the present invention, the label taken over from the pallet is conveyed such that its glue application surface moves past a glue application unit, the glue application surface of the label having, at least over part of its area, cold glue applied thereto during this movement. It follows that glue is applied directly and without any intermediate step onto the back of the label. The glue used according to the present invention may be highly fluid glues, glues having a viscosity between 600 and 80,000 mPa s and casein or dispersion glues with an optimum processing temperature between 18° C. and 34° C. In addition to cold glue application, also hot glue may be applied to subareas of the glue application surface of the label, the glue application unit being then configured in a suitable manner.

The now glue-coated label is then transferred from the pallet directly, i.e. without any detour via a gripper cylinder, to a container conveyed by a conveyor or a pack conveyed by the conveyor. For this purpose, the glue-coated side of the label can be moved, by pivoting or rotating the pallet, such that a leading edge of the label will be placed onto the surface of the container or pack to be labeled. Subsequently, the label is stripped off from the pallet by a controlled relative movement of the pallet and of the container, and applied to the container by rolling on.

As is in principle known in the prior art, the conveyor may be configured as a container table, a circulating carriage/rail system or the like with a plurality of holders for the containers or packs, said holders being rotatable about their own axis and configured e.g. in the form of rotary plates. By controlled rotation of the rotary plates during transfer of the labels to the containers or packs, the labels are rolled onto the surface of the containers or packs. The track of the containers in the area of label transfer may e.g. be circularly curved, as in the case of a carousel like container table, or straight, as in the case of a long stator linear motor drive or belt drive for the holders. The holders may be provided with individually controllable drive units, e.g. in the form of servomotors. By means of these drive units, the holders can be rotated in a controlled manner, so as to execute predetermined rotary movement profiles for taking over and wrapping the labels onto the containers. It goes without saying that the conveyor may comprise additional elements, which are known per se in the prior art, such as a container feeding device, e.g. in the form of an infeed star wheel, a container discharge device, e.g. in the form of a discharge star wheel, a separating screw or the like.

Due to the fact that the labels are taken over such that their back faces away from the pallet, the glue can be applied directly to the glue application side of the labels, without the detour of applying glue to the pallet or a respective glue segment of a glue carrier. Thus, the glue-coated labels are now conveyed by the pallets with the glue coat facing outwards, so that they can be applied directly from the pallet carousel to the containers to be labeled. Hence, the normally employed gripper cylinder, which was required for turning the labels prior to transferring them to the containers, is no longer necessary. The whole labeling unit can thus be provided with a simpler and more compact structural design. In addition, it will no longer be necessary to carry out maintenance and cleaning work for the gripper cylinder, so that the running life of the unit can be extended.

According to a further development, the glue application surface may have printed thereon a variable glue image, in particular according to the ink-jet method. As will be described hereinafter, the glue application unit may, for this purpose, comprise a large number of controllable glue nozzles, which are arranged relative to the circulatory path of the label back of the label conveyed by the pallet, such that the glue to be applied will be sprayed onto the glue application surface of the label while the latter is passing by. This can be done, e.g. by applying the glue in the form of dots or lines. When the label is pressed onto the container, the applied dots or lines will finally broaden and form glue areas, which cause the label to adhere reliably to the container surface. The glue nozzles may here especially work according to the ink-jet principle, with one or a plurality of rows of glue nozzles, which are oriented perpendicular to the direction of movement of the glue application surface, being accurately activated so as to achieve on the glue application surface a desired glue image, i.e. a desired dosing and distribution of the applied glue.

The control of the glue nozzles may here take place analogously to the control of the ink-jet nozzles of an ink-jet printer by means of a suitable open-loop and/or closed-loop control unit. In particular, glue application may be adapted to the shape and the size of the label, so that no glue will be applied outside the label onto the pallets, since this would result in contamination of the latter. In addition, due to the controlled dosage, the normally provided glue return flow can be dispensed with completely. The application of glue according to the ink-jet principle also has the effect that the glue will not be exposed to unnecessary influences through the ambient air, in particular through the oxygen contained therein, so that there will be no change in the glue characteristics. Application can take place in a contact-free manner by choosing the distance between the glue nozzle and the label large enough for allowing glue drops to separate from the nozzle opening as they do in a jet. Depending on the consistency of the glue used, e.g. a distance between 1 mm and 2.5 mm may be chosen. Alternatively, a smaller distance may be chosen, so that the glue will be applied in a contact process, the non-zero distance between the nozzle opening and the label being so small that it will be fully bridged by a glue drop. In this case, the glue nozzles may be configured e.g. as channel nozzles.

By changing the control of the glue nozzles, the applied glue image can be varied almost arbitrarily within the framework of the dimensions of the nozzle array. This allows processing of a great variety of label sizes and formats, also those of a complex nature, such as e.g. champagne bands. Also non-continuous glue images comprising e.g. separate leading-edge and trailing-edge glue coats for body labels can easily be dealt with. If, in addition to the cold glue, also hot glue is to be applied in certain areas, the glue application unit may be provided with separate, in particular heatable glue nozzles for this purpose. The glue images belonging to specific label formats may be stored, after the fashion of a type management, in a memory unit of the open-loop and/or closed-loop control unit, in particular in a programmable logic control unit, from where they are retrieved by a processor unit of the open-loop and/or closed-loop control unit for controlling the glue nozzles. Hence, the labeling process can be changed over to a different label format in a rapid and flexible manner.

According to an alternative further development, the glue application surface can areally be provided with cold glue by a glue roller of the glue application unit. Glue rollers are known per se in the prior art, so that a detailed description is here dispensed with. The glue roller may, for example, be coated with glue from a reservoir via a glue application bar which is known per se. By causing the back of the label conveyed by the pallet to roll on the circumferential surface of the glue roller by pivoting or rotating the pallet, the glue application surface of the label is areally provided with glue. Other than in cases where the above described glue printer is used, an application of glue outside of the label is avoided in the case of such areal application by configuring the pallet in a suitable manner. For example, the shape of the pallet or of a pallet segment, which takes up the label and which is in particular replaceable, may be adapted to the shape and size of the label. As will be described in more detail hereinafter, the label may, alternatively, be taken up at a plurality of suction openings of the pallet. The non-active suction openings, i.e. the suction openings which do not have negative pressure applied thereto, may e.g. remain at a position retracted by a few millimeters through a spring mechanism, while the label-holding suction openings project beyond the base of the pallet to a suitable extent. Thus, it can be guaranteed that only the glue application surface of the label, but not the inactive suction openings or other parts of the pallet will come into contact with the circumferential surface of the glue roller, so that contaminations caused by excess glue on the pallet can be avoided. However, the above-mentioned further development can normally not be used for applying to the back of the label a glue image that deviates from the area of the label.

According to another further development, the glue application unit may be supplied with cold glue by controlled deformation of a deformable glue reservoir. In order to allow this, the glue reservoir consists, at least partially, of a material, e.g. a plastic material, sheet metal or a foil, which is deformable by a deformation unit specially configured for this purpose and which is deformed in that it is mechanically acted upon by a deformation element of the deformation unit. The reservoir may e.g. have the shape of a can with an opening for the glue, and a die-shaped deformation element pushes the bottom, which is located opposite to the opening, successively into the interior of the can. The resultant reduction of volume causes an increase in the pressure of the glue in the reservoir, whereby the glue is squeezed out of the reservoir through the opening. By a controlled advance of the deformation element, it will be possible to control the amount of squeezed-out glue on the one hand and the pressure in the reservoir on the other, so that the reservoir walls can be prevented from bursting. Other possible forms of reservoirs are tubes, syringes, spheres and the like, the deformation elements used may then be complementary die- or roll-shaped deformation elements. A suitable structural design of the reservoir and of the deformation element allows a complete removal of the glue contained in the reservoir.

The opening of the reservoir, which is especially configured as an exchangeable reservoir, may be connected, e.g. via a screw coupling, to a complementary connection of the labeling device, from where the glue can be supplied via glue lines to the glue printer, in particular to the glue nozzles or glue channels of the latter. If the ink-jet method is used, the pressure built up through deformation may, at least partially, be used for operating the glue nozzles, so that the use of an additional glue pump can be dispensed with. If higher glue pressures are required, an additional glue pump may be provided.

As mentioned above, the glue reservoir may be configured as an exchangeable component, provided e.g. with a screw coupling. Thus, the reservoir can easily be replaced after having been emptied, and can then undergo recycling. Moreover, the emptied reservoir has normally been compacted through the deformation, whereby storage and transport costs can be kept low. Due to the fact that precisely the respective amount of glue needed is squeezed out of the reservoir, a glue return flow can, moreover, be dispensed with completely. In order to obtain an optimum processing temperature for the glue used, the reservoir and the glue lines or, alternatively, a cabinet-like housing of the reservoir and of the deformation unit may be cooled or heated, if necessary. For this purpose, suitable cooling or heating devices may be provided, which may in particular be configured as controllable elements.

According to a further development, the label may be taken over by means of a plurality of suction openings of the pallet through negative pressure. To this end, the pallet is configured as a so-called vacuum pallet having supplied thereto negative pressure via a vacuum system. Vacuum systems are well known in the prior art and will therefore not be described in detail in the present context. The vacuum system may e.g. comprise a controllable vacuum pump and a plurality of vacuum lines, which connect the vacuum pallets to the vacuum pump. It is also imaginable to use a rotary distributor, so as to supply negative pressure to the respective active vacuum pallets. In other words, the negative pressure supply may be configured such that the pallets have negative pressure supplied thereto for taking over and conveying the label and are separated from the negative pressure supply for the purpose of transfer and empty running. The suction openings may be distributed, e.g. in the form of a matrix, over the label contacting surface such that a large number of different label formats can be taken over from and conveyed by the vacuum pallet. For taking over the label from the label providing unit, the contacting surface of the pallet is moved past the image side of the label provided by the label providing unit for transfer, such that the image side is suctionally attracted by the suction openings. For this purpose, the suction openings may either be brought into mechanical contact with the label or they may be moved past the label at a small distance therefrom, e.g. smaller than or equal to 1 mm. Depending on the size and the material of the label, the negative pressure may be chosen such that the label will be reliably held on the vacuum pallet and will not be stripped off from the vacuum pallet, not even through the glue application process, and not even if glue application takes place through contacting.

According to another further development, the method may additionally comprise the controlled activation of a subset of the suction openings of the pallet, depending on the size and/or shape of the label to be taken over. To this end, the suction openings may be provided, e.g. individually or in groups, with controllable control valves, e.g. piezoelectrically operated valves, which are opened and closed by an open-loop and/or closed-loop control unit of the labeling machine in a controlled manner. By opening the valves, the suction openings are activated, i.e. supplied with negative pressure. By closing the valves, the suction openings are deactivated, i.e. separated from the negative pressure supply. According to the present further development, controlled activation takes place depending on the size and/or shape of the label to be taken over. For this purpose, the parameters concerning the size and/or shape may be stored in the open-loop and/or closed-loop control unit after the fashion of a type management, so that an exchange of labels can be executed in a rapid and flexible manner. To this end, the dimensions of the vacuum pallet are such that a large number of different label formats, such as body labels and shoulder labels, ribbon labels, wrap-around labels, front and rear labels or the like, can be taken over and conveyed. For example, the size of the vacuum pallet may be adapted to the dimensions of the wrap-around labels for the largest containers to be labeled. Also the number of suction openings is adapted to the size of the vacuum pallet. When a lower degree of flexibility is accepted, the suction openings may also be activated and deactivated in groups by supplying the respective groups with negative pressure, e.g. via a common control valve. In this way, the control can be simplified and installation costs can be saved.

Alternatively to the control via control valves, also automatic control through contact with the label to be taken over may be used, as will be described in more detail hereinafter. To this end, the pallet is brought into mechanical contact with the label to be taken over, such that the suction openings contacting the label will be activated, i.e. connected to the negative pressure supply, by the contact itself. This can be accomplished e.g. by the use of touch valves. This will automatically have the effect that only the suction openings which are required for taking over the label will be activated. As has already been mentioned and as will be described in more detail hereinafter, the non-required, i.e. inactive suction openings can automatically be retracted to a basic position, so that even an areal application of glue will apply glue only to the glue application surface of the label but not to the pallet and its suction mechanisms. The described alternative makes type management for controlling the suction openings superfluous, whereby the plant in its entirety can be simplified.

Provided that the vacuum output is sufficiently high, it will also be possible to do completely without any control of the suction openings. If it is accepted that the suction openings not covered by the transferred label will constantly draw in air, all the suction openings may always be supplied with negative pressure, i.e. remain activated. By way of example, the pallet may be configured with a vacuum pad which consists of a porous material, e.g. a sintered plastic material, and which has negative pressure supplied thereto. This, however, requires a higher vacuum output of the vacuum system used. In order to avoid an excessive increase in the amount of energy required, the suction openings may be distributed in the label contacting surface of the vacuum pallet in accordance with a likelihood of their use. For example, a particularly large number of openings may be provided in an area which will be occupied by the majority of label formats, whereas specific areas for special formats will be equipped with a lesser density of suction openings.

Also the size of the openings may be chosen in accordance with this likelihood. Hence, the main burden of suction performance will normally be borne by the frequently used suction openings. The vacuum pallets described can be used in a particularly easy manner. Care should, however, be taken that glue will not be applied to the non-occupied part of the contacting surface, so as to avoid in particular clogging of the non-occupied suction openings. To this end, e.g. the described method for applying a desired glue image, in particular according to the ink-jet method, may be used.

It is also imaginable to retrofit the employed pallets for use with a different label format by attaching or incorporating an accessory, e.g. a hole template, which is adapted to the label format and which blocks the suction openings not required. Finally, it is also imaginable to exchange the vacuum pallets, or at least the vacuum pallet parts comprising the contacting surface, for the purpose of retrofitting for use with a different label format.

According to a special further development, the suction openings of the pallet may be deactivated for transferring the glue-coated label to the container or the pack. As has been described hereinbefore, the suction openings can be deactivated by separating them individually or in groups from the negative pressure supply, e.g. by means of individually controllable control valves. Alternatively, the whole vacuum pallet may be separated from the negative pressure supply, e.g. by interrupting the vacuum line supplying the pallet, for transferring the glue-coated label. By deactivating the suction openings holding the label, the latter will be released from the vacuum pallet, so that it can be transferred without any major effort to the containers or packs to be labeled.

Alternatively or additionally, the pallet may have applied thereto compressed air for transferring the label. To this end, it will either be possible to connect the already existing suction openings to a compressed air supply, or holes which are specially provided in the contacting surface of the pallet for this purpose may have applied thereto compressed air. By way of example, a leading edge of the conveyed label may be lifted off from the contacting surface by applying compressed air, and may then be placed onto the container to be labeled. By rotating the container to be labeled, the label is subsequently fully applied to the container surface by rolling on. The relative movement between the container holders and the pallet will here support this roll-on process. It follows that, for transferring the labels to the containers or packs to be labeled, the use of an additional device, in particular of the normally employed gripper cylinder, will not be necessary according to the present invention. This has the effect that the labeling process can be simplified on the one hand and executed at a more reasonable price on the other. Pressure application can again be controlled by means of an open-loop and/or closed-loop control unit of the labeling device.

The above-mentioned objects are also achieved by an apparatus for carrying out the above-mentioned methods. The apparatus may here especially have the apparatus features described hereinafter.

Likewise, the above-mentioned objects are achieved by a labeling device for applying labels to containers or packs, said labeling device comprising a conveyor for the containers or packs, a label providing unit for providing labels, a glue application unit for applying cold glue to the labels, and a transfer device comprising at least one pallet for taking over a label from the label providing unit and for supplying the label to the conveyor, wherein the transfer device is arranged between the label providing unit and the conveyor such that the label is taken over from the label providing unit by the pallet in such a way that a glue application surface of the label faces away from the pallet, and that the label conveyed by the pallet is transferred directly to a container conveyed by the conveyor or a pack conveyed by the conveyor; wherein the glue application unit is configured and arranged relative to the transfer device such that the glue application surface of the label, which is moved past the glue application unit by the pallet, has cold glue applied thereto, at least over part of its area; and wherein the transfer device comprises a pallet carousel with a plurality of pallets, which are adapted to be driven such that they circulate around an axis of rotation and which, in particular, are pivotable in a controlled manner about pivot axles that are displaced relative to the axis of rotation.

The same variations and further developments, which have been described hereinbefore in connection with the method of applying labels to containers or packs according to the present invention, may also be applied to the labeling device. In particular, the conveyor for the containers or packs may, as has been mentioned hereinbefore, be configured as a container table, a circulating carriage/rail system or the like with a plurality of holders for the containers or packs, said holders being rotatable about their own axis and configured e.g. in the form of rotary plates. The holders may circulate on a container table in the form of a carousel on a circular track or they may be moved linearly in the area of label transfer to the containers or packs, e.g. by means of a belt drive or a chain drive, a conveyor belt or a long stator linear motor drive. The holders may be provided with individually controllable drive units, e.g. in the form of servomotors, by means of which they can be rotated in a controlled manner, so as to execute predetermined rotary movement profiles for taking over and wrapping the labels onto the containers. To this end, the holders may hold the containers from below, as in the case of rotary plates, and/or fix them from above, as e.g. in the case of centering bells. It goes without saying that the conveyor may comprise additional elements, which are known per se in the prior art, such as a container feeding device, e.g. in the form of an infeed star wheel, a container discharge device, e.g. in the form of a discharge star wheel, a separating screw or the like.

As described above, the label providing unit may comprise one or a plurality of label boxes for providing individual labels. Alternatively, the label providing unit may be configured such that it comprises a stockpiling unit for one or a plurality of label tape rolls, a feed unit for feeding the label tape as well as a cutting unit for separating individual labels from the label tape. As has already been mentioned and as is known per se, a rotating perforating or cutting roll in engagement with the circumferential surface of a mating cutting cylinder may be provided for this purpose, and the mating cutting cylinder may here be configured as a vacuum roll on which the separated labels are held by means of negative pressure. The labels can be taken over from the vacuum roll or the label box by the at least one pallet. The labels in the label box or the label tape on the mating cutting cylinder are here oriented such that they will be taken over by the pallet with their image side, i.e. with their image side facing a contacting surface of the pallet and, consequently, with their glue application side facing away from the pallet. It follows that the conveying unit is arranged relative to the label providing unit such that, for taking over the labels, the pallets are guided such that their contacting surface will move tangentially past the label box or the vacuum roll. For transferring the labels, a mechanical contact between the pallet and the label can be established, or transfer may be effected through negative pressure in that the pallet passes by at a small distance. The vacuum roll and the transfer device may have provided between them additional elements, such as a further vacuum roll or a gripper cylinder, which, for separating the labels of a perforated label tape, rotate at a higher speed than the mating cutting cylinder. The orientation of the label tape will suitably be adapted in this case.

According to the present invention, the transfer device is configured such that it comprises at least one pallet for taking over a label and for supplying the label to the conveyor. As described above, the transfer device comprises here a pallet carousel with a plurality of pallets, which are adapted to be driven such that they circulate around an axis of rotation, or is configured as such a pallet carousel, and the pallets may here especially be pivotable in a controlled manner about individual pivot axles displaced relative to the axis of rotation, and/or rotatable in a controlled manner. As mentioned above, such a pallet carousel is, in principle, known from U.S. Pat. No. 3,736,213. As described above, the pallets may eccentrically be supported on their pivot axles such that the curved contacting surface of the pallet will roll optimally, i.e. without slipping, on a flat surface of the type defined e.g. by the image side of a label provided by a label box. Such flat rolling-on can also take place when the labels are being transferred to linearly conveyed containers or to a cyclically operated container table, in the case of which the container holder is only rotated, but not advanced, during transfer. In the latter case, an eccentric support can be completely dispensed with. By increasing the eccentricity of the support of the pallets, it will additionally be possible to realize optimal rolling-on also on a curved surface, as will be the case e.g. when the containers are conveyed by means of a container table in a continuous mode. The roll-on movement is here obtained by a superposition of the container rotation and the movement of the holders in combination with the circulation of the pallets around the axis of rotation of the pallet carousel and the pivotal movement of the pallets about the respective pivot axle. In the simplest case, the curved contacting surfaces of the pallets are configured as circular segments of a cylinder. Alternatively, the curvature of the contacting surface may, however, also vary along the contacting surface such that an optimum roll-on behavior is obtained also in the case of a centric support. However, an eccentric support will normally take up less space than a centric one, so that more pallets can be accommodated on a pallet carrier rotating about an axis of rotation.

As has already been mentioned, the supports of the pallets on the pallet carrier may be configured such that the eccentricity of the pivot axle can be changed during circulation around the axis of rotation. To this end, the support may be changed with respect to the contacting surface, e.g. by means of a controllable linear actuator. The control of the linear actuator can be adapted by means of the above-mentioned open-loop and/or closed-loop control unit, depending on a position of the pallet along the circulatory path. For example, the eccentricity prevailing when a label is taken over from a label box may be smaller than that at the point where the label is transferred to the containers guided on a container table. The change in the eccentricity of support may alternatively also be changed automatically by means of one or a plurality of control cams of the pallet carousel, possibly in cooperation with a resetting-type spring device for the support, while the pallets circulate around the axis of rotation of the carousel. The control cams may here simultaneously also cause pivoting of the pallets. Alternatively, the pivotal movement and/or rotation of the pallets may be effected by means of one or a plurality of servomotors. Also in this case, control will again be executed by a suitable open-loop and/or closed-loop control unit of the labeling machine.

According to the present invention, a glue application unit is arranged on the circumference of the pallet carousel downstream of the label providing unit, when seen in the direction of circulation. Due to the fact that the pallets circulate around the axis of rotation, the glue application surfaces thereof are thus moved past the glue application unit and have cold glue applied thereto, at least over part of their area. As has already been described, the glue can here be applied areally by means of a glue roller which is known per se, in that the back of the label conveyed by the pallet rolls on the circumferential surface of the glue roller due to a pivotal or rotating movement of the pallet. As has already been described, a variable glue image may alternatively be printed according to the ink-jet method onto the glue application surface of the label that is moved past the glue application unit. In either case, the glue is applied directly to the glue application surface of the conveyed labels, which faces away from the pallet. Since the glue-coated side of the labels thus faces outwards, the transfer device may simultaneously be used for applying the labels directly onto the containers or packs to be labeled. Hence, the normally employed gripper cylinder is no longer necessary, whereby the whole system can be provided with a more compact and less expensive structural design.

According to a further development, the labeling device may additionally comprise a negative pressure supply unit, in particular a vacuum pump, the at least one pallet being here configured as a vacuum pallet with a plurality of suction openings on a contacting surface of the pallet for the labels to be conveyed. The suction openings may here result from the natural porosity of a vacuum pad defining the contacting surface and consisting e.g. of a sintered plastic material. The suction openings may, however, also be defined by holes in the contacting surface of the pallet, which may be arranged in the form of a matrix, as has been described hereinbefore. In addition, the suction openings may be distributed over the contacting surface of the pallet according to the likelihood with which they will be required for conveying a certain label format, so that more suction openings will be provided at locations where a part of the label to be conveyed comes to lie with high likelihood. It goes without saying that the labeling device may comprise additional elements of a vacuum system which are known per se, such as e.g. vacuum lines supplying the suction openings continuously or in a controlled manner with negative pressure from the vacuum pump. Furthermore, the vacuum pump may be controllable.

If the pallets are configured as vacuum pallets, a direct mechanical contact between the pallet and the label provided by the label providing unit can be dispensed with insofar as, for small distances, the suction power of the suction openings will suffice for taking the labels over from the label providing unit. The pallets, in particular the pivotal movement thereof, can thus be controlled more easily, and wear of the labeling machine will be reduced. In addition, the adhesion established by the suction openings allows the labels to be taken over by pallets having no glue coat, so that the labels can be conveyed with their image side facing the pallets. Consequently, the labels can, after having been glue coated by the glue printer, be applied to the containers directly, i.e. without a gripper cylinder.

According to a special further development the pallet may, as has already been mentioned, be configured such that the suction openings can be supplied with negative pressure individually or in groups. For this purpose, individual ones or groups of the suction openings may be provided with control valves in their vacuum supply lines, and these control valves may e.g. be miniaturized as piezoelectric elements. The suction openings may also be connected in groups to a respective vacuum line that is adapted to be closed by a control valve. The groups may here preferably be defined depending on frequently used label formats. A single vacuum palette can thus be used in a flexible manner for conveying a plurality of label formats.

The control valves may be provided as part of an open-loop and/or closed-loop control unit of the labeling device, said control unit being configured for accurately supplying the suction openings of the pallet with negative pressure. For this purpose, the above-mentioned control valves may be connected via respective signal lines to the open-loop and/or closed-loop control unit, which opens or closes the valves, as required, depending on the processed label format. Which valves are to be opened for a specific label format and which valves are to be closed may be stored, after the fashion of a type management, in a memory unit of the open-loop and/or closed-loop control unit and can be retrieved therefrom by a processor unit of the open-loop and/or closed-loop control unit for changing over to a different label format. A product change can thus be accomplished in a particularly easy manner.

Such change of the label format can be carried out even more easily, if the suction openings are provided with valves in such a way that, when a mechanical contact with the label to be taken over is established, they will automatically be connected to the negative pressure supply. This can be accomplished e.g. by providing the suction openings with individual touch valves, which are opened by pressure applied to a push element. The label surface contacting the touch valve is thus automatically subjected to the negative pressure communicated through the associated suction opening and will therefore adhere to the pallet. According to a further development, the suction openings may be configured, with or without a touch valve, in the form of suction cups, so as to maximize the effect of the negative pressure. Other than in the case of the above-described holes, the suction cups project here beyond a base of the pallet, and the control may take place via control valves or touch valves as described above.

Configuring the suction openings by means of suction cups with touch valves additionally allows another attractive further development. The suction cups may be supported by means of a spring device such that they are vertically adjustable relative to the base of the pallet. The spring mechanism and the touch valve may here be configured such that two possible positions of the suction cup relative to the base are obtained. If the touch valve is operated through mechanical contact with the label, a first negative pressure will be applied to the entire displaceable suction cup, said negative pressure being thus also communicated by the suction opening. Due to this fact and due to the effect of this negative pressure on the vertically adjustable parts, the spring mechanism is compressed down to a first height above the base. If the touch valve is closed, the suction opening will not have applied thereto any pressure, but a second higher negative pressure will be applied to vertically adjustable parts of the suction cup such that it will compress the spring mechanism even more, so that the suction cup will be retracted to a second, lower position. The different negative pressures may e.g. be generated by an opening, which is provided in a channel leading to the suction opening and which is adapted to be closed by the touch valve, and a channel-closing element of the touch valve, which are not open at the same time.

Alternatively, the touch valve used may be a three-way valve, which generates different negative pressures depending on a position of the touch valve, said negative pressures causing, in turn, the suction cup to assume different positions above the base. The negative pressures may here be generated by a single vacuum system, e.g. by means of a butterfly valve, or by two separate vacuum systems. As a result, the suction cup with the touch valve can be configured such that, if a label is in contact therewith, the clear height between the suction cup and the base will be larger than that in the unladen condition. It follows that, among the large number of suction cups, those which are not required for conveying the transferred label will automatically be retracted to a lower basic position. To this end, the touch valve may be provided with an additional spring mechanism which automatically returns the valve to a closed position in the unladen condition. Since, consequently, only the active suction cups, i.e. the suction cups covered by the label, will remain at the higher position, it will also be possible to execute an areal application of glue by means of the glue application unit, without contaminating the non-used suction cups with glue. If the ink-jet method is used, the suction cups may, however, be configured as stationary elements, whereby control of the suction openings will be simplified substantially.

As has already been mentioned, the vacuum pallets may also be configured such that retrofitting to a different label format can be accomplished by inserting or pushing in an accessory, e.g. in the form of a hole template. The accessory will here prevent access of the non-required suction openings to the negative pressure supply. As has already been mentioned hereinbefore, a control of the suction openings may also be dispensed with completely, when higher vacuum losses are accepted.

In all the above-mentioned cases, the vacuum pallets may be configured sufficiently large for allowing the handling of a large number of label formats to be processed. Additionally or alternatively to the individual or groupwise control of the suction openings, the negative pressure supply of the vacuum pallet in its entirety may be controlled depending on a position of the vacuum palette along its circulatory path around the axis of rotation. For example, the negative pressure supply for the whole pallet may be activated in the area of the label providing unit, so as to take over a label, and deactivated in the area of the conveyor, so as to transfer the label to the container to be labeled. To this end, the negative pressure supply unit may comprise one or a plurality of suitable control valves in the supply lines of the pallets, said control valves being controlled by the open-loop and/or closed-loop control unit. Also a rotary distributor for vacuum transfer to the pallets is imaginable.

According to a special further development, the labeling device may comprise an interrupter, which is configured for interrupting the negative pressure supply of the pallet, when the label is applied to the containers or packs. This interrupter may be configured as a mechanical element blocking the negative pressure supply in the area of transfer of the label, or as part of the open-loop and/or closed-loop control unit ensuring that the control valves of the pallet or of the supply line will be closed for transferring the label. Transferring the label to the container to be labeled can be facilitated by interrupting the negative pressure supply.

In addition, the labeling device may comprise a compressed air system which communicates with the pallets via compressed air lines such that at least part of the suction openings or holes provided separately for this purpose in the contacting surface can be acted upon by compressed air in a controlled manner. Also in this case, the control may take place via suitable control valves and by means of the open-loop and/or closed-loop control unit. Due to the compressed air flowing out, the label can be released from the contacting surface and the suction cups, respectively, in a particularly easy manner and placed on and pressed onto the container.

As has already been mentioned, the glue application unit may comprise a large number of controllable glue nozzles, which are controllable in particular individually and by means of which a variable glue image can be printed onto the glue application surface of the label. The glue image may here especially be printed according to the ink-jet method. To this end, the glue application unit has a print head comprising a large number of controllable glue nozzles, which are arranged relative to a path of movement of the label conveyed by the conveying unit, such that the glue to be applied will be sprayed onto the glue application surface of the label while the latter is passing by. Depending on the size of the distance chosen between the opening of the glue nozzles and the glue application surface, application may take place in the form of a jet with glue drops separating from the nozzle opening or in a quasi-contact mode, where the distance is smaller than the typical diameter of the glue drops. In the first case, the distance may e.g. be between 1 mm and 2.5 mm, whereas in the second case it will be less than 1 mm. The glue nozzles may be arranged along one or a plurality of rows, which are oriented perpendicular to the path of movement of the label and tangentially to the contacting surface. Neighboring rows may be "staggered" relative to one another in a vertical direction so as to increase the print resolution of the glue image. In addition, the print head may be configured for pivoting about a vertical and/or horizontal axis so that an optimum impingement angle for the glue drops can be adjusted.

As has already been described, the glue nozzles may accurately be activated and deactivated, individually or in groups, so as to be able to print a glue image, which is adapted to the label format, onto the glue application surface of the label while the latter is passing by. Also in this case, control may take place after the fashion of a type management by means of an open-loop and/or closed-loop control unit and respective glue images stored in a memory unit. The glue print head may operate according to the DoD technology (drop-on-demand). Almost arbitrary glue images can be produced in this way. In addition, the glue may be applied in a contact-free manner, so that the label will neither shift on nor be stripped off from the pallet. The glue application surface to be glue-coated can, in the area of the glue application unit, be caused to pass by with a desired speed and at a desired distance by controlled pivoting of the pallets.

Finally, the glue-coated labels are applied to the containers by renewed controlled pivoting of the pallets. In order to allow also a reliable application of shoulder labels, the pallets may additionally be configured such that they are a pivotable about a horizontal axis, the tilt angle being controllable especially by means of a control cam of the transfer device.

According to another further development, the labeling device may, as described above, additionally comprise a controllable deformation unit for removing cold glue from a deformable reservoir by deforming the reservoir. The deformation unit may here be configured in the way that has already been described hereinbefore, in particular with respect to the deformation element, the connection to the supply line of the glue application unit and the control of deformation. Likewise, the reservoirs used for the cold glue may be configured as described above.

The labeling devices described may be provided as part of a machine block together with additional components, such as a filling machine for filling the containers. Within the meaning of the present invention, the term machine block is to be understood such that at least the machines for filling, sealing and labeling, which are comprised in the machine block, are fixed in position on a common machine frame and/or that their machine frames are connectable to one another in a mechanically stationary manner for the production process, e.g. by screwing together, clamping or the like. The machine frames may be composed of a plurality of fixedly interconnectable modules, mounting platforms or the like for individual machines, treatment units and/or transfer star wheels of the machine block.

Accordingly, a transfer of containers between the individual machines of the machine block is possible in a space-saving and precise manner by means of transfer star wheels, such as infeed star wheels and discharge star wheels, screw conveyors or the like.

Preferably, the machine block may additionally comprise a stretch blow molder, which is formed upstream of the filling machine and used for producing containers from a plastic material, in particular from PET. This allows a particularly compact structural design and reduces the risk of contamination of the containers on their way to the filling machine and the machines of the machine block downstream of the filling machine.

Preferably, the machine block may comprise, upstream of the filling machine, an inspection unit and/or a rinser for containers made of glass. This allows a particularly compact structural design and reduces deficiencies during conveyance and/or due to contamination of the containers between the inspection unit, the rinser and the filling machine. Preferably, the filling machine, the sealing machine and the labeling machine may be configured as rotary machines with continuous conveyance of the containers, in particular in this sequence. This allows a high performance of the machines of the machine block.

Preferably, the filling machine, the sealing machine and the labeling machine may be directly coupled to one another, as regards conveyance, by transfer star wheels, such as infeed star wheels, discharge star wheels, star wheel conveyors or the like. In addition, separating screws or the like may be provided between discharge star wheels and infeed star wheels. Preferably, additional machines of the machine block, such as e.g. the stretch blow molder, can be coupled thereto in the same way so as to allow conveyance therebetween.

The labeling device may have a modular structural design of such a nature that it is also suitable for labeling with leaf-shaped labels. A modular type labeling device will be of advantage. The labeling device can here be docked to the machine periphery, in particular at the machine carousel to a vertically-adjustable, ground-supported equipment accommodation unit, such that it is exchangeable and movable by means of rollers.

The methods and apparatuses described allow a direct application of glue to the back of labels and the subsequent direct transfer of the labels to the containers to be labeled. The normally used gripper cylinder can thus be dispensed with. By using a glue printer as a glue application unit, it is, moreover, no longer necessary to use the maintenance-prone glue roller. In addition, making use of such a glue printer, an arbitrary glue image can be applied to any label format that can be conveyed by means of the pallet. By suitably configuring the vacuum pallet, a great variety of different label formats can thus be processed without retrofitting the labeling device. In particular, a change of pallets will no longer be necessary for this purpose.

BRIEF DESCRIPTION OF THE FIGURES

Additional features and exemplary embodiments as well as advantages of the present invention will be explained in more detail hereinafter with reference to the drawings. It goes without saying that the embodiments do not exhaust the scope of the present invention. It also goes without saying that some or all of the features described hereinafter may also be combined with one another in other ways.

Figure 1:
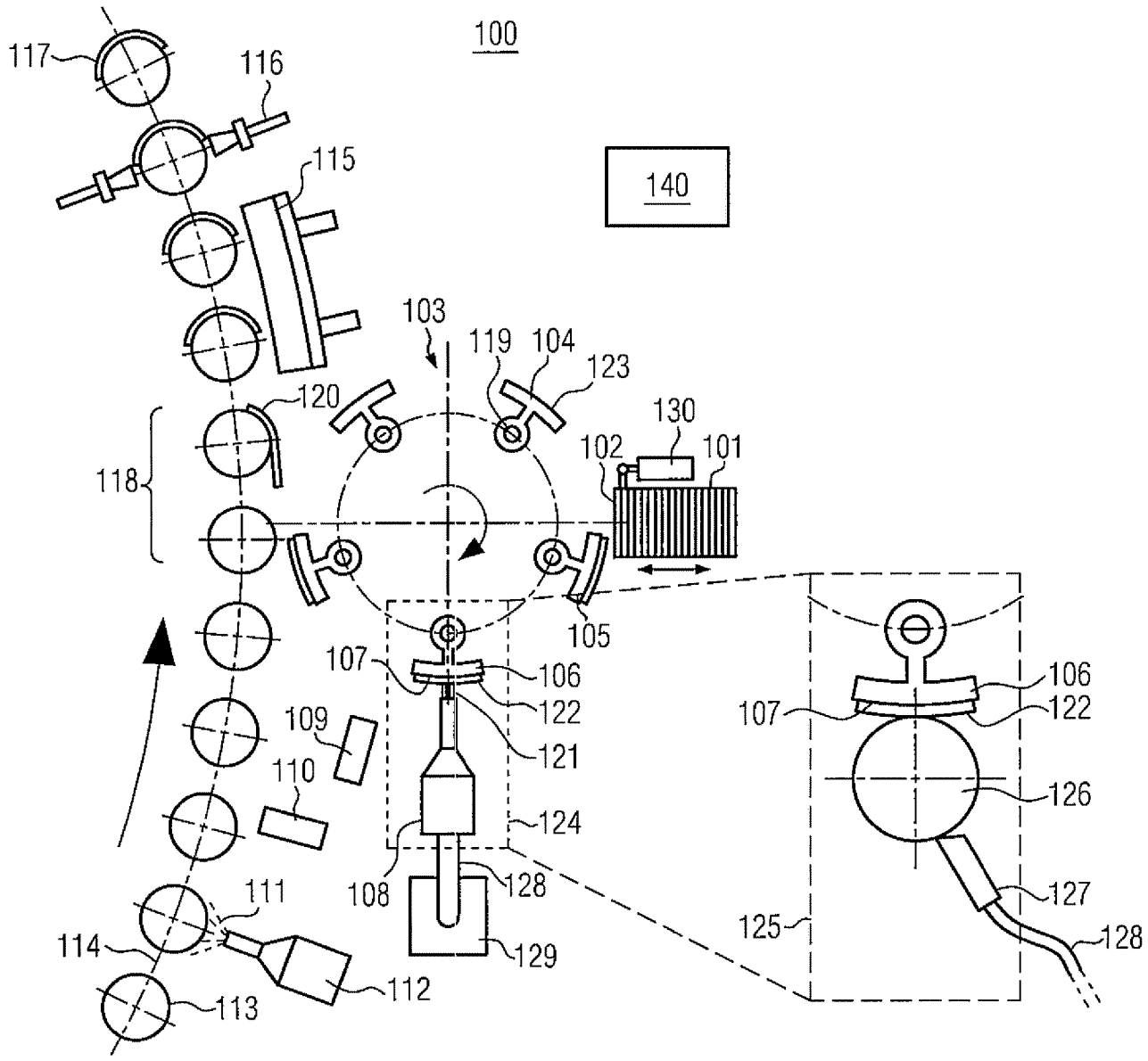
FIG. 1 shows schematically a top view of a labeling device according to the present invention.

In the following, identical or similar elements are designated by identical reference numerals. These elements will not be described repeatedly for the sake of clarity. In addition, it goes without saying that in the following embodiments some of the elements or all of the elements can be replaced by or combined with similar elements described in connection with other embodiments.

DETAILED DESCRIPTION

FIG. 1 shows a schematic representation of a labeling device according to the present invention in a top view. In the further development shown here, the labeling device 100 comprises a conveyor, which is configured as a container table 114 and along which the containers 113 or packs to be labeled circulate on a curved track on a plurality of holders that are rotatable about their own axis (not shown). The depicted, non-limiting further development additionally shows further frequently used elements of a labeling device. For example, a pretreating unit 112 may be provided, which prepares the container to be labeled 113 for the labeling process by cleaning and premoistening the container surface to be labeled or by subjecting said container surface to blow cleaning, a heating and/or radiation and/or plasma and/or corona treatment. In addition, sensors 109 and 110 may be provided, which measure the condition of the surface to be labeled, e.g. smooth, rough, etc., and/or ambient conditions, such as e.g. an ambient temperature or humidity, and transmit this information to the open-loop and/or closed-loop control unit 140 for controlling the labeling device. Furthermore, a roll-on unit 115 and/or a brush-on unit 116 may be provided downstream of the labeling position 118, so as to fully apply the label 120 placed onto the container and press it onto the latter. The containers provided with the label 117 are then transferred to a subsequent treatment station, e.g. a filling station for filling with a liquid foodstuff.

According to the present invention, the labeling device 100 comprises a transfer device 103 with at least one pallet 104, 105, 106. In the further development shown, the transfer device 103 is configured as a pallet carousel comprising a plurality of pallets 104, 105, 106, which circulate around an axis of rotation of the pallet carousel and which, in turn, are configured such that they are pivotable about eccentrically supported pivot axles 119 of their own. The pallets have on their outwardly directed side a contacting surface 123, which may be sufficiently large for accommodating a plurality of different label formats. While circulating around the axis of rotation of the pallet carousel 103, the initially unladen pallet 104 is moved past a label magazine 101 in the form of a label box, which is arranged on the periphery of the pallet carousel, and simultaneously pivoted such that the contacting surface 123 of the pallet will take over from the label box 101 the frontmost label 102 presented with its image side. Since, as will be described hereinafter in more detail, the pallets 104, 105, 106 are configured as vacuum pallets, this transfer can reliably be carried out even without applying glue to the contacting surface 123 in advance. In order to be able to adapt the distance between the frontmost label 102 and the pallet carousel 103, the label box 101 may be configured such that it can be switched via a pneumatic cylinder 130.

Since the labels 102 are provided such that their image side faces forwards, they will also come to lie with their image side on the contacting surface 123 of the pallet 105. It follows that the glue application surface 122 of the labels 107 conveyed by the pallets 105 and 106 faces away from the contacting surface of the respective pallet. The thus outwardly directed glue application surface of the label 107 can therefore have glue applied thereto directly on the pallet by means of a glue application unit 124 and 125, respectively, arranged on the circulation path of the pallets 104, 105, 106, i.e. on the circumference of the pallet carousel 103. FIG. 1 shows, as alternatives, a glue application unit 124 operating according to the ink-jet method as well as an area-type glue application unit 125.

When a glue printer 108 is used, the cold glue is sprayed directly onto the glue application surface 122 in the form of a glue jet 121 from a large number of glue nozzles. To this end, the glue application surface 122 is moved past the openings of the glue nozzles preferably at a constant distance therefrom by circulating and pivoting the pallet 106. By accurately controlling the glue nozzles, e.g. according to the DoD principle (drop-on-demand), an almost arbitrary glue image can be printed onto the glue application surface 122 in superposition with the pallet movement. In particular, precisely the necessary amount of cold glue can be applied by printing, so that a glue return flow can be dispensed with completely.

Alternatively, a glue application unit 125 may be used for areally applying glue to the glue application surface 122 of the label 107. As regards this glue application unit 125, FIG. 1 only shows schematically the basic components glue roller 126, glue scraper 127 and glue supply line 128. The cold glue supplied via the glue supply line 128 is applied by means of the glue scraper or glue application bar 127 to the circumferential surface of the glue roller 126, on which the glue application surface 122 of the label 107 rolls when the pallet 106 is passing by. This leads to an areal application of glue to the glue application surface. Glue supply lines, glue rollers and glue scrapers are well known in the prior art and, consequently, they will not be described in detail in the present context. Other than in the case of the glue application unit 124 operating according to the ink-jet method, it is not possible to apply an arbitrary glue image when the glue is applied areally. On the contrary, measures have to be taken for preventing an application of glue to parts of the pallet 106 which are not covered by the label 107, since this would result in contaminations and failures. In addition, a glue return flow for excess glue running down from the glue roller 126 may perhaps be required.

Such a glue return flow will, however, not be necessary, when the supply of glue takes place via the glue supply line 128 in a controlled manner and in the amount required by means of one of the above described, controllable deformation units. This is indicated in FIG. 1 for the glue application unit 124, but can also be used for the glue application unit 125. An exemplary further development of the deformation unit 129 will be described hereinafter in connection with FIG. 3.

Since the cold glue is applied to the outwardly directed glue application surface 122, a gripper cylinder for placing the now glue-coated labels 107 onto the containers to be labeled 113 is, other than is normally the case in the prior art, not necessary. Instead, the labels are placed directly from the pallets 104, 105, 106 onto the containers 113 moving past the labeling position 118, and are wrapped therearound by a rotary movement of the holders of the container table 114. To this end, the pallets are moved past the container surfaces and simultaneously pivoted such that, in combination with the rotary movement of the containers and their circulatory movement around the container table, the carried-along labels will be applied to the container surfaces by rolling on. As has already been mentioned, a slip-free roll-on application of the labels to the container surfaces can be accomplished by a suitable eccentric support of the curved pallets 104-106 on their respective pivot axles 119, so that the labels applied will not shift unintentionally.

The circulatory movements of the pallets 104, 105, 106 and of the holders of the container table 114 may be controlled by means of controllable drives (not shown) via the open-loop and/or closed-loop control unit 140 of the labeling device 100. Likewise, the rotary movement of the holders for the containers can be controlled, e.g. via individually provided servomotors, in an open loop and/or in a closed loop mode by means of the open-loop and/or closed-loop control unit. The pivotal movements of the pallets 104, 105, 106 can be controlled in an open loop and/or in a closed loop mode by means of the open-loop and/or closed-loop control unit via suitable control cams or also via servomotors that are specially provided for this purpose. Finally, the vacuum supply and the glue nozzles can be controlled via the open-loop and/or closed-loop control unit 140 as described hereinafter. The open-loop and/or closed-loop control unit may especially be a programmable logic control unit comprising a memory unit, e.g. in the form of a flash memory, having stored therein the storage parameters, e.g. with respect to the desired glue image, required for the purpose of control.

Figure 2:
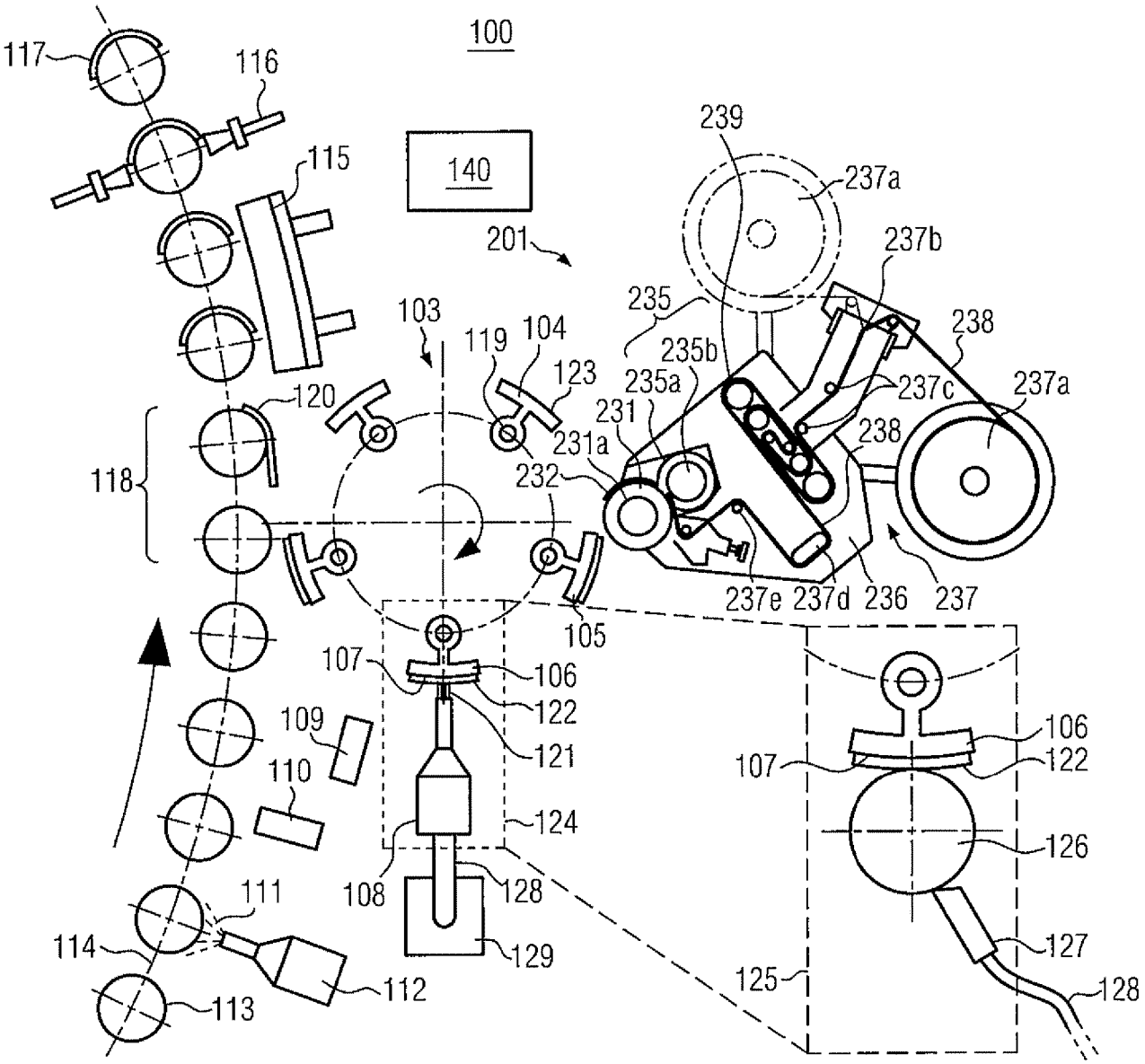
FIG. 2 shows a variation of the labeling device of FIG. 1 for label tapes.

FIG. 2 shows a variation of the further development according to FIG. 1 comprising a label-tape providing unit 201. As has already been mentioned, like reference numerals designate like elements, so that a renewed description is dispensed with for the sake of clarity. According to this further development, the labels are, however, provided in the form of label tapes, instead of a label magazine, the individual labels being separated from these label tapes by means of a cutting unit.

A base frame 236 has arranged thereon a feed unit 237 for feeding a label tape 238 with a plurality of labels that are not glue-coated. In the further development shown, the feed unit 237 comprises two stocking units 237*a*, e.g. in the form of label tape rolls, a splicing unit 237*b* for automatic roll exchange, deflection rollers 237*c*, a loop buffer 239, a track control unit 237*d* for guiding the label tape 238, and a conveying unit 237*e* including e.g. a spring-loaded drive roller for the label tape.

In addition, a cutting unit 235 and a transfer cylinder 231 are provided downstream of the feed unit 237. The cutting unit 235 is shown with a rotor 235*a* driven by an individually controllable drive unit 235*b* with the desired rotational frequency. The blades (not shown) secured to the rotor 235*a* cut the fed label tape 238 into individual labels 232, which are then transferred to the pallets 104, 105, 106. Cutting of the label tape 238 is carried out in engagement with the mating cutting cylinder 231, which also serves as a transfer cylinder for transferring the labels 232 to the pallets 104, 105, 106. The transfer cylinder 231 is here preferably configured as a negative pressure cylinder having suction openings formed in its circumferential surface, e.g. as a so-called vacuum roll, the label tape or the labels being suctionally attracted to said vacuum roll and held thereon. The transfer cylinder 231 may be driven via an individually controllable drive unit 231*a* synchronously with the rotary movement of the rotor 235*a*. Analogously to the above-described taking over from a label box, the separated labels 232 are, also according to this further development, taken over by moving the pallets 104, 105, 106 past the transfer cylinder 231. The circulatory and pivotal movements of the pallets 104, 105, 106 are here controlled by the open-loop and/or closed-loop control unit 140 in accordance with the rotational frequency of the mating cutting cylinder 232.

Figure 3:
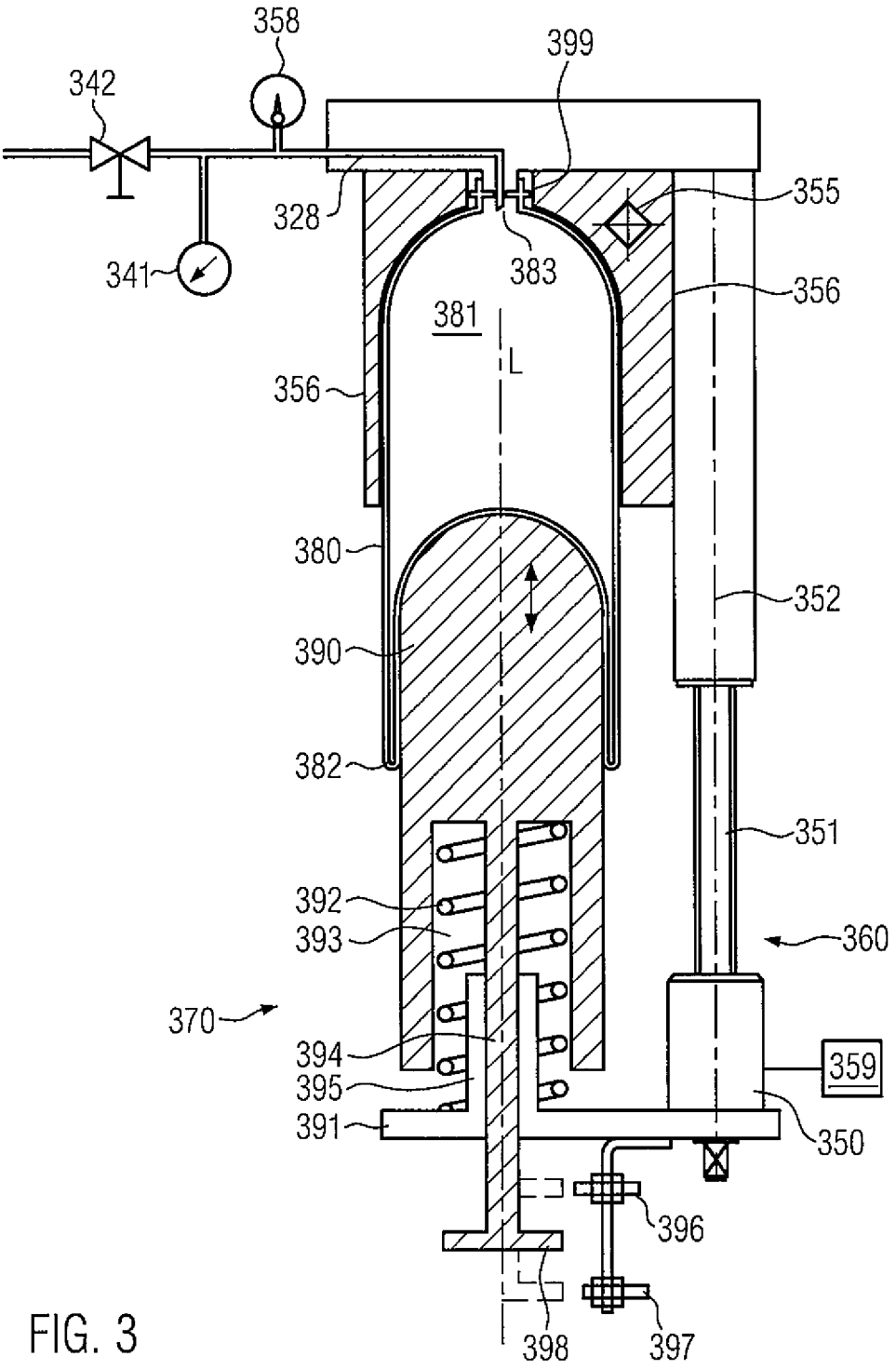
FIG. 3 shows a cross-section through a schematic representation of a device for removing cold glue by deformation of a reservoir according to the present invention.

FIG. 3 shows a cross-section through a schematic representation of a cold-glue removing device 370 according to the present invention. When such a device is used, the removal of glue from a deformable reservoir 380 is carried out in that a deformation unit 360 acts on the reservoir, whereby the glue accommodation volume 381 of the latter is reduced. The resultant pressure in the glue squeezes the amount of glue to be removed out of an opening 383 of the reservoir.

In the non-limiting embodiment shown here, the deformation of the reservoir 380 is effected in that the wall of the reservoir is directly mechanically acted upon by a deformation element 390. To this end, the deformation element 390 according to this embodiment is adapted to be moved relative to the reservoir 380 along the longitudinal direction L by means of a motor 350, which causes a spindle 351 to move, said spindle engaging a stationary complementary mating thread 352. The motor 350 may be configured for being controlled in an open-loop and/or closed-loop mode, so that this relative movement can be controlled in an open-loop and/or closed-loop mode by means of an open-loop and/or closed-loop control unit 359. In the embodiment shown in the present figure, the part of the removing device 370 holding the reservoir 380 is stationary, whereas the deformation element 390 moves relative thereto. It goes without saying that the arrangement can be modified such that, alternatively or additionally, the reservoir can be moved relative to the deformation element.

The reservoir 380 has its opening 383 connected to a connection 399 of the apparatus, e.g. via a screw thread. Owing to the screw thread, an empty reservoir can thus easily be replaced by a full reservoir. Via the opening 383 and the connection 399, the squeezed-out glue is transferred to a conveying line 328, which, as has been mentioned hereinbefore, advances the glue to the glue roller. The conveying line may be provided with a control valve 342 so that the dispensed amount of glue can be controlled precisely. Furthermore, a pressure sensor 341 and/or a temperature sensor 358 may be provided, said sensors measuring the pressure and the temperature of the glue in the conveying line 328. The measured data can be transmitted to the open-loop and/or closed-loop control unit 359 and can thus be incorporated into the open-loop and/or closed-loop control of the motor 350 of the drive unit.

In the embodiment shown here, the deformation element 390 is supported on a carrier 391, the deformation element and the carrier having provided between them a spring 392 which biases the deformation element against the carrier. The spring 392 shown is here arranged in an opening 393 of the deformation element 390. Furthermore, the deformation element 390 comprises a rod 394 guided in a guide 395 of the carrier 391. According to the present embodiment, the carrier 391 has arranged thereon two sensors 396 and 397, which detect a position of a projection 398 arranged on the rod 394. Depending on signals emitted by these sensors, which may e.g. be light barriers or magnetically operating sensors, a movement of the carrier 391 can be controlled such that the projection 398 will always be located between the two sensors 396 and 397. In this way, a predetermined force applied by the spring 392 to the deformation element 390 can be adjusted and, consequently, also a predetermined pressure on the glue contained in the reservoir 380. Excessive pressure, which may result in tearing of the reservoir wall, can thus be avoided effectively.

By a relative displacement of the deformation element 390 along the longitudinal direction L, the surface of the deformation element, which is configured such that it resembles the shape of the upper part of the reservoir 380, can first be brought into mechanical contact with the lower part of the reservoir and then be moved into the reservoir by further displacement. In the course of this process, the reservoir will be deformed such that the lower part of its wall is pushed into the accommodation volume 381, so that a curved edge 382 of the deformed reservoir 380 will be obtained. As the displacement of the deformation element 390 continues, the wall of the reservoir will be pushed into the interior of the reservoir further and further. This has the effect that almost all the glue contained in the reservoir will gradually be squeezed out of the latter. The shape of the reservoir 380 and of the deformation element 390 can be chosen such that the number of gaps for glue which are formed during the deformation process will be as small as possible. Accordingly, a die-shaped deformation element may, as shown here, be configured with a slightly smaller cross-sectional area than that of the reservoir, so that it can be pushed into said reservoir.

The wall or at least the deformable part of the wall of the reservoir 380 is formed of a material, e.g. PET, which is adapted to be deformed by the force exertable by the deformation unit 360, and has a suitable wall thickness. Different areas of the wall may consist of different materials and/or be formed with different wall thicknesses. In particular, it is desirable that, in the further development shown, the upper part of the reservoir 380, which is not to be deformed, will not deform and thus bulge, since otherwise complete emptying of the reservoir and a controlled glue pressure cannot be guaranteed. In order to stabilize the part of the wall of the reservoir 380 which is not to be deformed, the deformation unit shown here comprises a housing 356 for accommodating this part of the reservoir, said housing being brought into contact with an outer surface of the reservoir part which is not to be deformed, in such a way that it encloses this part in a sleevelike manner. The part of the reservoir wall which is in direct mechanical contact with the housing 356 is thus prevented from bulging due to the increasing pressure in the accommodation volume 381. Moreover, the housing 356 may be provided with a controllable heating and/or cooling device 355 allowing the glue contained in the accommodation volume 381 to be heated or cooled to an optimum processing temperature. The heating and/or cooling device 355 may here be controlled with due regard to the glue temperature measured by the temperature sensor 358.

A large number of alternative embodiments of the removing device 370 is imaginable. For example, the deformation element 390 may be configured as a stationary element, whereas the reservoir 380 is moved by the drive unit 350. In addition, the connection 399 for the opening 383 may be arranged below the reservoir 380. It is also imaginable to configure the connection 399 and part of the conveying line 328 as part of the deformation element 390, the conveying line 328 comprising, in the case of a moving deformation element 390, preferably at least one flexible part. The shape and the nature of the deformation unit 360 may additionally be adapted to the possible shapes of the reservoir.

Figure 4B:
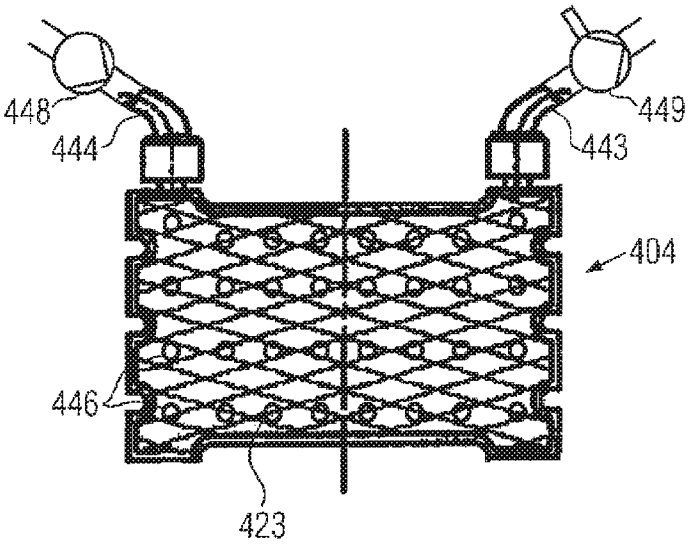
FIG. 4B shows a front view of the vacuum pallet according to FIG. 4A.
Figure 4A:
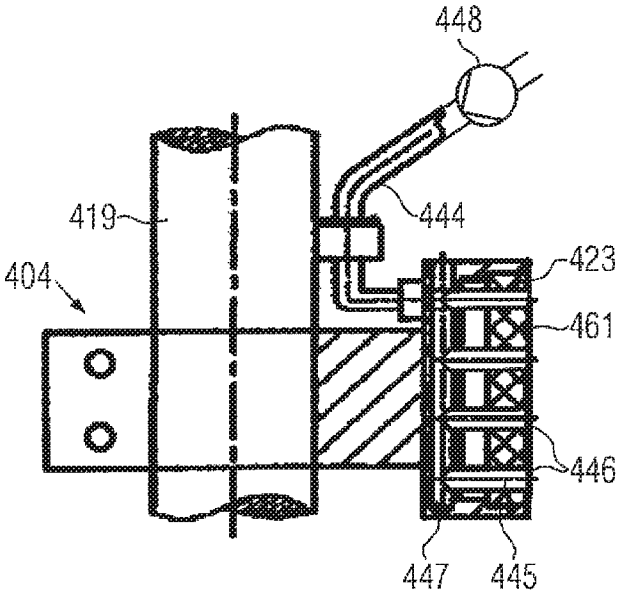
FIG. 4A shows a side view of an exemplary vacuum pallet according to the present invention.

FIG. 4A shows a side view of an exemplary vacuum pallet 404 according to the present invention. FIG. 4B shows the associated front view of the pallet. According to this non-limiting further development, the pallet shown is supported eccentrically such that it is pivotable about a pivot axle 419. In addition, the vacuum pallet 404 shown is provided with a vacuum pad 461 consisting of a porous sintered plastic material, such as polytetrafluoroethylene (PTFE) or hard polyethylene (high-density polyethylene—HDPE), whose microchannels transmit the negative pressure generated by a vacuum pump 449 via a vacuum supply line 443 to the label contacting surface 423 of the vacuum pallet 404. Alternatively or additionally, a plurality of suction openings 446 may be provided in the contacting surface 423 as shown in the figures, said suction openings communicating via channels 445 with one or a plurality of main channels 447. The main channel 447 may, in turn, communicate with the vacuum supply line 443 and may thus be supplied with negative pressure. Alternatively or additionally, the main channel 447 may communicate via a compressed air supply line 444 with a compressed air supply unit 448, e.g. a pump, so that the openings 446 can have applied thereto compressed air for detaching a conveyed label. The vacuum supply lines 443 and the compressed air supply lines 444 of a plurality of pallets may here be connected via a common, or via two separate rotary distributors to the vacuum pump 449 and the compressed air supply unit 448, respectively.

The vacuum pump 449 and the compressor 448 may be configured controllably in such a way that, depending on the position of the vacuum pallet 404 circulating around the pallet carousel 103, said pallet can have applied thereto negative pressure or compressed air by means of the open-loop and/or closed-loop control unit 140 of the labeling device as described above. Alternatively or additionally, control valves (not shown) may be provided in the supply lines 443 and 444, said control valves being opened and closed by the open-loop and/or closed-loop control unit 140 in a controlled manner. Likewise, in particular piezoelectrically configured control valves, which can be opened and closed individually or in groups by means of the open-loop and/or closed-loop control unit 140, may be provided in individual channels 445 for the suction openings 446. In this way, a supply of the suction openings with negative pressure adapted to the format of the labels to be conveyed can be realized, as shown e.g. on the left hand side of FIG. 6.

Figure 5B:
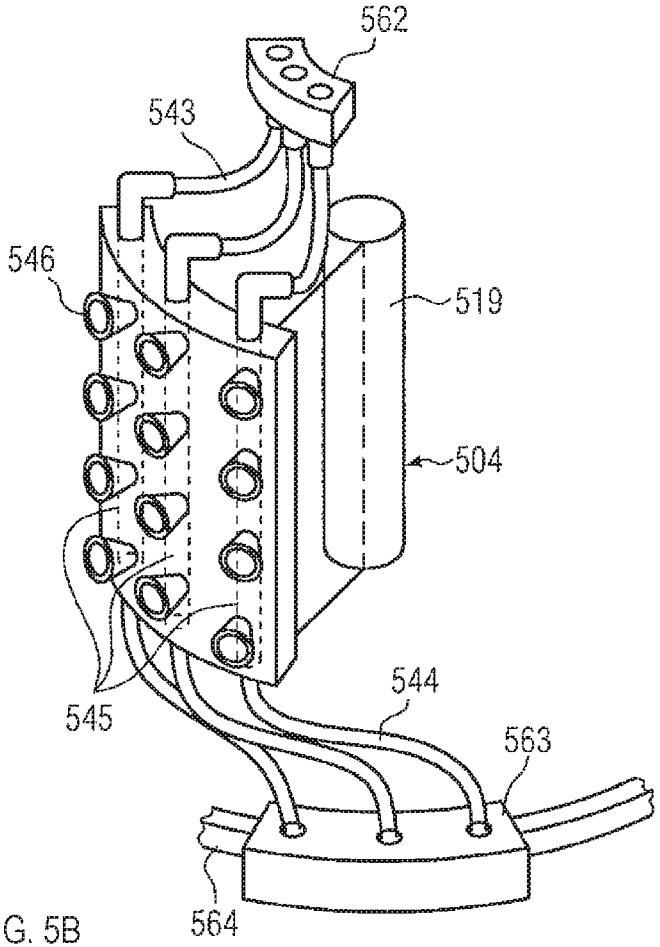
FIG. 5B shows a perspective view of the vacuum pallet according to FIG. 5A.
Figure 5A:
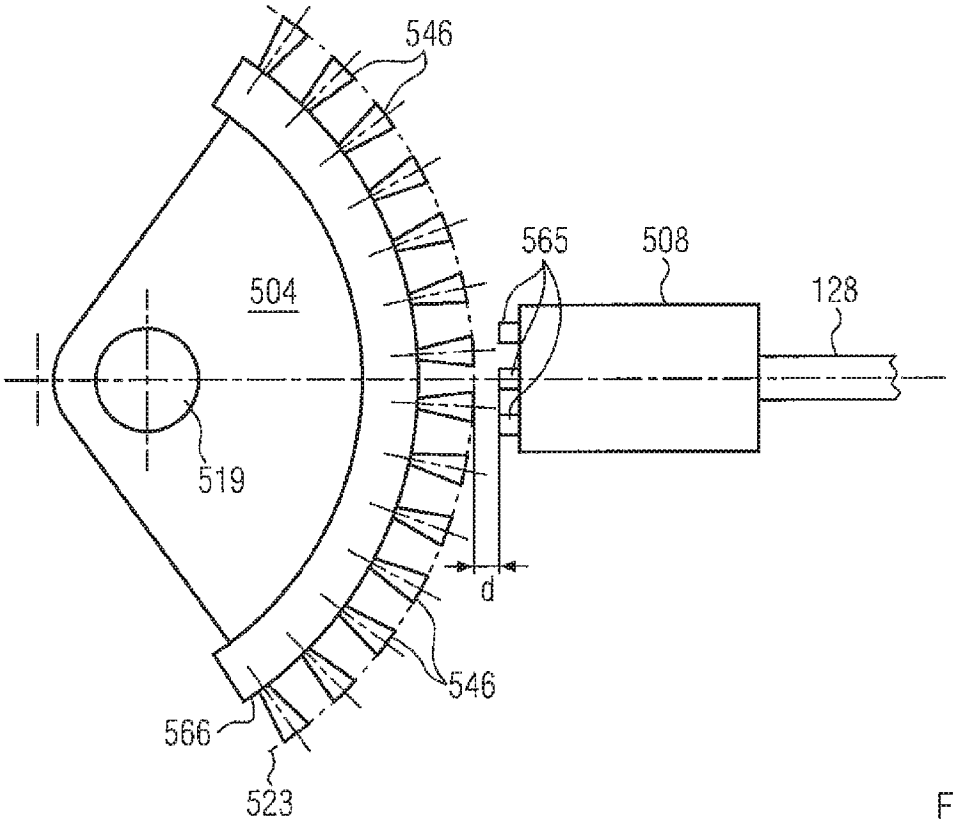
FIG. 5A shows a schematic cross-section of an alternative embodiment of a vacuum pallet according to the present invention.

FIG. 5A shows a schematic cross-section of an alternative embodiment of a vacuum pallet according to the present invention. In addition, this subfigure shows a cross-section of a glue application unit configured as a glue printer 508. FIG. 5B additionally shows a perspective view of the vacuum pallet 504. As has already been described more than once, the figures show a vacuum pallet 504 which is eccentrically supported on a pivot axle 519, the vacuum pallet according to the present further development having, however, a plurality of suction openings in the form of suction cups 546 on its curved outer surface. Hence, the openings of the suction cups 546 define the label contacting surface 523 which extends above the base area 566 of the pallet. By suitably configuring the suction cups such that they comprise touch valves, the suction cups which are not occupied by a label can be retracted to a passive position, as shown e.g. in FIG. 7.

In the non-limiting further development shown, the suction cups 546 of the vacuum pallet 504 are groupwise connected via supply channels 545 to a vacuum distributor 562 as well as to a compressed air distributor 563. For this purpose, the supply channels have one of their ends connected to vacuum supply lines 543, whereas the opposite ends are connected to compressed air supply lines 544. The vacuum distributor 562 and/or the compressed air distributor 563 may especially be configured as rotary distributors, e.g. by providing an annular compressed air supply 564. The pallet 504 can thus be supplied with negative pressure and compressed air, respectively, along its entire circulatory movement around the pallet carousel 103. Just as in the case of the embodiment according to FIG. 4, suitable control valves, which are, however, not shown for the sake of clarity, may also be provided in this case.

Subfigure 5A additionally shows a schematic cross-section of a glue application unit operating according to the ink-jet method and comprising a glue printer 508. Via a glue supply line 128, the cold glue is, in proper doses, supplied to the glue printer 508, e.g. by means of the above-described removing device, said glue printer spraying the cold glue via a large number of glue nozzles 565 directly onto the glue application surface of a label conveyed by the vacuum pallet 504. By pivoting the vacuum pallet 504 about the pivot axle 519, the glue application surface is moved past the glue nozzles 565 preferably at a constant distance d therefrom, so that by controlled activation and deactivation of the glue nozzles an almost arbitrary glue image can be applied to the label. Control of the glue nozzles can here be executed by the open-loop and/or closed-loop control unit 140.

Figure 6:
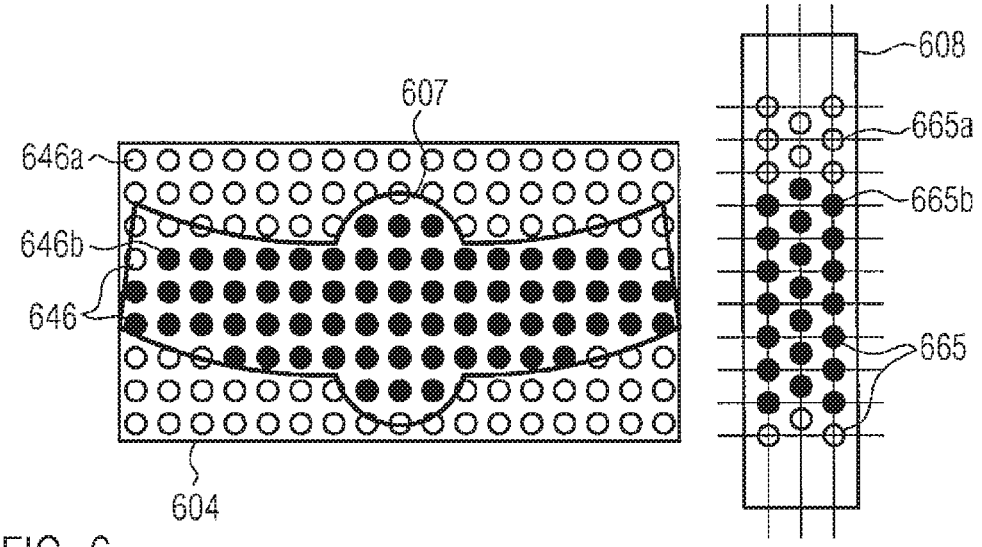
FIG. 6 shows schematic front views of a vacuum pallet and of a glue nozzle array of a glue printer according to the present invention.

As shown on the right-hand side of FIG. 6, the glue printer 608 may comprise a plurality of rows of glue nozzles 665 which are arranged in parallel and the direction of which is oriented perpendicular to the direction of movement of the label 607 and tangentially to the contacting surface of the vacuum pallet 604. The right-hand side of the figure shows a front view of the nozzle array of the glue printer 608, whereas on the left-hand side of the figure a front view of the vacuum pallet 604 is shown.

The front view of the glue printer 608 shows a large number of glue nozzles 665, which, according to the depicted, non-limiting further development, are arranged in three parallel rows. For increasing the resolution of the printed glue image, the rows may be "staggered" relative to one another, in that the glue nozzles of the central row are positioned in a vertical direction between the glue nozzles of the respective neighboring rows. In the present figure, the glue nozzles 665*b* required for applying glue to the exemplarily indicated shoulder label 607 are shown in a filled condition, whereas the non-required glue nozzles 665*a* are shown in an open condition. While the vacuum pallet 604 is passing by, the respective required glue nozzles 665*b* are activated in a controlled manner such that glue will be applied only to the glue application surface of the shoulder label 607, but not to the non-occupied contacting surface of the vacuum pallet. Depending on the dimensions of the nozzle array in a vertical direction, labels of an almost arbitrary size and shape can be coated with glue in this way.

The vacuum pallet 604 shown in the left-hand part of FIG. 6 comprises, according to the present further development, a large number of suction openings 646, which are arranged in the form of a matrix and which may optionally be configured as suction cups. As has already been mentioned, control valves may be provided in the supply channels of the suction openings, the suction openings being adapted to be activated and deactivated individually or in groups by means of these control valves. It follows that only the activated suction openings have a negative pressure applied thereto during operation. In the present figure, the activated suction openings 646*b* are shown in a filled condition, whereas the deactivated suction openings 646*a* are shown in an open condition. The activation pattern shown corresponds here to the shape of the outlined shoulder label 607. By controlling the control valves via an open-loop and/or closed-loop control unit 140 of the labeling device, labels of an almost arbitrary shape can thus reliably be conveyed on the contacting surface of the vacuum pallet 604, without any unnecessary vacuum output being required. The respective activation patterns may here be stored together with the respective glue application image or images in a memory unit of the open-loop and/or closed-loop control unit after the fashion of a type management.

Figure 7A:
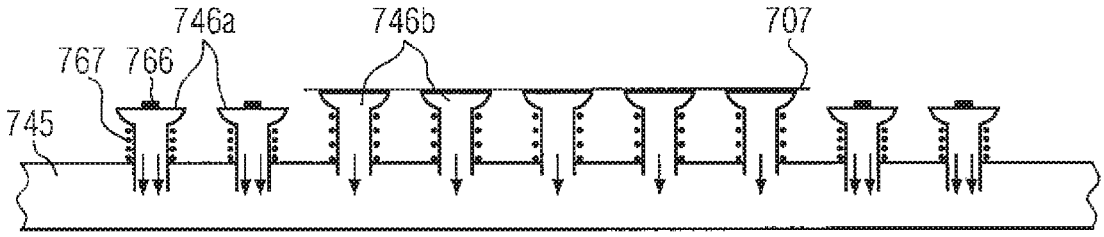
FIG. 7A shows a special embodiment of a vacuum pallet with suction cups according to the present invention.

FIG. 7A shows a special embodiment of a vacuum pallet with suction cups according to the present invention. The embodiment shown represents an alternative for controlling the suction openings via control valves by means of an open-loop and/or closed-loop control unit, in the case of which the suction openings to be activated are activated automatically on the basis of the shape of the label 707 to be taken over. To this end, the suction cups may be configured such that they are vertically adjustable relative to a base of the vacuum pallet, a spring mechanism 767 being provided such that the unladen, i.e. deactivated suction cups 746*a* will remain at a first, low position above the base and a vacuum line 745 connecting the suction cups, whereas the suction cups 746*b*, which are laden with a label 707, i.e. activated, are located at a second, higher position above the base. Activation and deactivation of the suction cups take here place automatically in that the label 707 to be taken over comes into mechanical contact with the push elements 766 of touch valves provided individually per suction cup. If, during the pivotal movement of the pallet, the push element 766 is actuated through mechanical contact with the image side of the label to be taken over, the spring 767 will push the suction cup to the second position, whereas the negative pressure prevailing in the vacuum line 745 will keep the non-activated suction cups 746*a* at the first position against the effect produced by the spring. The forces acting on the suction cups are exemplarily indicated in Subfigure 7A by arrows.

Figure 7B:
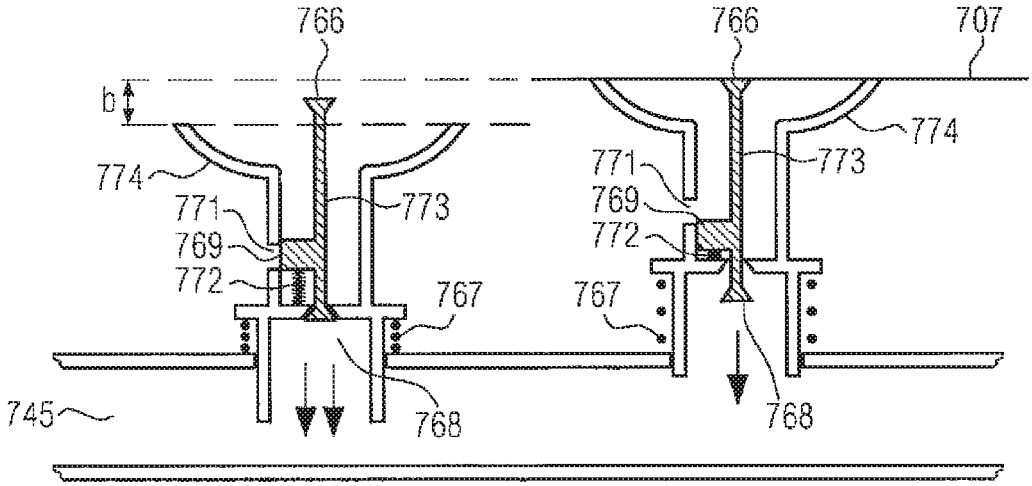
FIG. 7B shows an exemplary embodiment of a suction cup with a touch valve according to the present invention.

FIG. 7B shows an exemplary embodiment of such a suction cup with a touch valve. A plurality of alternative embodiments are imaginable, e.g. through making use of a two-way valve or a three-way valve and through providing two separate negative pressure lines. In the further development shown, the suction cup, which is movable relative to the base of the pallet, is supported relative to the vacuum line 745 via a spring mechanism 767. The touch valve 766 comprises, in the simplified representation shown, a shaft-like tappet 773 having, on the lower end thereof, a plug 768, which is pressed via a second spring mechanism 772 into a complementarily shaped opening of the touch valve and which thus closes said opening. Moreover, in the closed condition of the touch valve, the push element 766 projects beyond the plane of the actual suction cup 774, so that a mechanical contact with a label 707 will apply a force along the longitudinal axis of the tappet 773. In the non-limiting further development shown, the channel of the suction cup is provided with an opening 771 located on the circumferential side and closed, in the deactivated condition, by a pin 769 fixed to the tappet 773. Hence, the deactivated suction cup has applied thereto a force, which results from the difference between atmospheric pressure and the negative pressure in the vacuum line 745. The resultant force compresses the spring 767 to such an extent that the whole suction cup is shifted to a low position. It follows that the thus retracted suction cup will especially not come into contact with the surface of a glue roller used for areally applying glue to the label 707, so that contaminations through glue on the suction cups can be avoided.

In the activated condition shown on the right-hand side of FIG. 7B, the tappet 773 has been shifted, through mechanical contact of the push element 766 with the label 707 to be taken over, against the force of the spring 772 to such an extent that the plug 768 will clear the opening of the channel of the suction cup. This has the effect that the pressure in the channel decreases, but not down to the negative pressure prevailing in the vacuum line 745, but, due to the partial clearing of the opening 771 through the pin 769, to a lower negative pressure, i.e. a negative pressure lying between the pressure of the vacuum line 745 and atmospheric pressure. This lower negative pressure will, due to the large area of the suction cup 774, suffice to hold the tappet 773 at the activated position, but the force applied to the spring mechanism 767 by said lower negative pressure will be smaller than the force applied in the closed condition. The entire suction cup is thus shifted to a second, higher position, which lies above the low position at a distance b therefrom. It follows that the mechanism shown allows an areal application of glue to the glue application surface of the transferred label 707 by means of a glue roller or a similar glue application unit, without the non-used parts of the contacting surface being contaminated with glue. In addition, a separate control of the suction openings via control valves is rendered superfluous, when individual touch valves are used.

The labeling devices described allow cold glue to be directly applied, in the form of almost arbitrary glue images, to the glue application surfaces of labels of an almost arbitrary shape and size. In addition, due to direct glue application, the glue-coated labels can be placed directly by the pallets onto the containers to be labeled. A gripper cylinder, which would otherwise be necessary, is thus no longer required. Moreover, the use of the ink-jet method for applying glue to the labels allows a precise and economical glue application, whereby resources and costs will be saved.

The invention claimed is:

1. A method for applying labels to containers or packs, comprising the following steps:

taking over a label from a label providing unit by means of a pallet which is adapted to be driven such that it circulates around an axis of rotation and which is pivotable in a controlled manner about a pivot axle at which the pallet is eccentrically supported and that is displaced relative to the axis of rotation, such that a glue application surface of the label faces away from the pallet;

conveying the label by means of the pallet past a glue application unit, where the glue application surface of the label has glue, including cold glue, applied thereto, at least over part of an area of the label; and subsequently, directly transferring the glue-coated label to a container or to a pack, either conveyed by a conveyor, wherein the glue application surface of the label has printed thereon a variable glue image by applying the glue to the glue application surface of the label in the form of at least one of dots and lines, and wherein the variable glue image is printed onto the glue application surface of the label according to an ink-jet method.

2. The method according to claim 1, wherein the glue application unit has cold glue supplied thereto by controlled deformation of a deformable glue reservoir.

3. The method according to claim 1, wherein the label is taken over through negative pressure by means of a plurality of suction openings of the pallet.

4. The method according to claim 3, further comprising controlled activation of a subset of the plurality of suction openings of the pallet, depending on a size and/or a shape of the label to be taken over.

5. The method according to claim 3, wherein the plurality of suction openings of the pallet is deactivated for transferring the glue-coated label to the container or the pack.

6. A labeling device for applying labels to containers or packs, comprising:

a conveyor for the containers or packs;

a label providing unit for providing the labels;

a glue application unit for applying cold glue to the labels; and a transfer device comprising at least one pallet for taking over a label from the label providing unit and for supplying the label to the conveyor;

wherein the transfer device is arranged between the label providing unit and the conveyor such that the label is taken over from the label providing unit by the at least one pallet in such a way that a glue application surface of the label faces away from the at least one pallet, and that the label conveyed by the at least one pallet is transferred directly to a container or to a pack, either conveyed by the conveyor;

wherein the glue application unit is configured and arranged relative to the transfer device such that the glue application surface of the label, which is moved past the glue application unit by the at least one pallet, has glue, including cold glue, applied thereto, at least over part of its area;

wherein the transfer device comprises a pallet carousel with a plurality of pallets which are adapted to be driven such that they circulate around an axis of rotation and which are pivotable in a controlled manner about pivot axles at which the pallets are eccentrically supported and that are displaced relative to the axis of rotation, wherein the glue application unit comprises a plurality of glue nozzles, which is controllable, including individually controllable, and wherein by means of the plurality of glue nozzles a variable glue image is printed onto the glue application surface of the label by applying the glue to the glue application surface of the label in the form of at least one of dots and lines, and wherein the glue application unit is configured to print the variable glue image in accordance with an ink-jet principle by applying the glue in a jet with glue drops.

7. The labeling device according to claim 6, further comprising a negative pressure supply unit, wherein the at least one pallet is configured as a vacuum pallet with a plurality of suction openings on a contacting surface of the at least one pallet for the labels to be conveyed.

8. The labeling device according to claim 7, wherein the at least one pallet is configured such that the plurality of suction openings can be supplied with negative pressure individually or in groups.

9. The labeling device according to claim 7, further comprising an open-loop and/or a closed-loop control unit configured for supplying the plurality of suction openings of the pallet with negative pressure in a controlled manner via a plurality of control valves.

10. The labeling device according to claim 7, further comprising an interrupter which is configured for interrupting a negative pressure supply of the at least one pallet when the label is applied to the containers or packs.

11. The labeling device according to claim 6, further comprising a controllable deformation unit for removing the cold glue from a deformable reservoir to be supplied to the glue application unit, where the controllable deformation unit comprises a deformation element configured to mechanically act upon the reservoir to squeeze the cold glue out of the reservoir.

12. The method according to claim 1, wherein the ink-jet method includes applying the glue in a jet with glue drops.

13. The method according to claim 4, wherein the plurality of suction openings of the pallet is deactivated for transferring the glue-coated label to the container or the pack.

14. The labeling device according to claim 7, where the negative pressure supply unit is a vacuum pump.

15. The labeling device according to claim 6, where the plurality of glue nozzles includes heatable glue nozzles.

16. The labeling device according to claim 6, further comprising an open-loop and/or closed-loop control unit having a memory unit storing glue images corresponding to a plurality of label formats.

17. The labeling device according to claim 6, where the plurality of glue nozzles is arranged at a distance from the glue application surface lying in a range from 1 mm to 2.5 mm.

18. The labeling device according to claim 6, where the plurality of glue nozzles is arranged at a distance from the glue application surface that is smaller than 1 mm.

19. The method according to claim 1, further comprising:

storing glue images corresponding to a plurality of label formats in a memory unit.

20. The method according to claim 1, further comprising:

changing an eccentricity of a support of the pallet at the pivot axle by means of a controllable linear actuator or at least one control cam.

21. The labeling device according to claim 6, further comprising:

at least one controllable linear actuator configured to change an eccentricity of a support of the pallets at the pivot axles.

22. The labeling device according to claim 6, wherein the pallet carousel comprises at least one control cam configured to change an eccentricity of a support of the pallets at the pivot axles.

* * * * *